US005290849A

United States Patent [19]

Lee

[11] Patent Number: 5,290,849

[45] Date of Patent: Mar. 1, 1994

[54] POLYMER SOLUTION FOR SIZING PAPER

[75] Inventor: Kang I. Lee, Longmeadow, Mass.

[73] Assignee: Monsanto Company, St Louis, Mo.

[21] Appl. No.: 972,338

[22] Filed: Nov. 6, 1992

[51] Int. Cl.[5] ..... C08F 8/30; C08F 220/14

[52] U.S. Cl. ..... 524/555; 526/272

[58] Field of Search ..... 524/555; 526/272

[56] References Cited

U.S. PATENT DOCUMENTS

| | | | |
|---|---|---|---|
| 2,469,407 | 5/1949 | Powers et al. | 117/161 |
| 2,577,624 | 12/1951 | Niles | 117/139.5 |
| 2,675,370 | 4/1954 | Barrett | 260/78.5 |
| 2,698,264 | 12/1954 | Niles | 117/139.5 |
| 2,723,195 | 11/1955 | Blake | 92/3 |
| 2,739,062 | 3/1956 | Griggs | 95/88 |
| 3,872,039 | 3/1975 | Vaughn et al. | 524/35 |
| 3,925,328 | 12/1975 | Shibahara et al. | 524/549 |
| 4,115,331 | 9/1978 | Tominaga et al. | 524/499 |
| 4,305,869 | 12/1981 | Lee | 525/74 |
| 4,381,367 | 4/1983 | von Bonin et al. | 524/811 |
| 5,122,568 | 6/1992 | de Pierne et al. | 524/819 |

*Primary Examiner*—Paul R. Michl
*Assistant Examiner*—Edward Cain
*Attorney, Agent, or Firm*—Michael J. Murphy; William J. Farrington; Mark F. Wachter

[57] ABSTRACT

The ammonium salt of a polymer of styrene and maleic anhydride includes 0.02 to 0.20 weight fraction copolymerized $C_1$-$C_3$ alkyl methacrylate to improve paper signing properties.

5 Claims, No Drawings

POLYMER SOLUTION FOR SIZING PAPER

BACKGROUND OF THE INVENTION

This invention relates to formulations for sizing paper and more particularly to solutions of polymers of styrene and maleic anhydride for alkaline sizing of paper.

Ammonium salts of polymers of styrene and maleic anhydride dissolved in water are known for use in sizing paper. See, for example, U.S. No. 2,261,169, col. 7, lines 59–61. Sizing is the treatment of paper fibers to improve properties such as ink printability and penetration, gloss, porosity and the like. Alkaline surface sizing wherein polymeric ammonium salt solutions are used with starch or the like as filler is becoming increasingly important to improve the durability of paper over time insofar as reducing its tendency to yellow. Moreover, alkaline surface sizings facilitate using increased filler in the paper substrate and therefore reduced, relatively expensive paper fiber without loss in paper properties. It would be desirable to modify these polymeric solutions used in alkaline sizing to enhance their capability to improve the properties of paper on which they are deposited.

SUMMARY OF THE INVENTION

Now improvements have in fact been made in solutions of polymer ammonium salts for alkaline sizing of paper.

Accordingly, a principal object of this invention is to improve the alkaline sizing properties of ammonium salt solutions of styrenemaleic anhydride polymers.

Another object is to achieve such improvements by modifying the polymer component of such solutions.

These and other objects are accomplished in an aqueous solution of polymer for alkaline sizing of paper wherein the polymer is represented by the formula:

$$CH_2—CHC_6H_5CHCONH_2—CHCOO^-(NH_4)$$

by providing the improvement wherein such polymer includes copolymerized monomer of the formula:

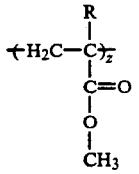

wherein x, y and z are weight fractions within the following ranges: x from 0.45 to 0.83; y from 0.15 to 0.35; z from 0.02 to 0.20 and R is $C_1-C_3$ alkyl.

R is preferably methyl and preferred weight fraction ranges are: x, 0.58 to 0.78; y, 0.20 to 0.30 and z, 0.02 to 0.10. The dissolved polymer has relatively high molecular weight between 100,000 to 300,000 Daltons weight average molecular weight.

DETAILED DESCRIPTION

This invention is the unexpected improvement in sized paper properties achieved by including a specified amount of copolymerized $C_1-C_3$ alkyl, preferably methyl, methacrylate monomer in the initial unsaturated polymeric composition to be reacted with ammonium hydroxide to form the aqueous solution used as a component of the paper sizing formulation. More specifically, such polymeric composition comprises a separately prepared terpolymer of styrene, maleic anhydride and such $C_1-C_3$ alkyl methacrylate which is reacted with ammonium hydroxide to form the dissolved amide/ammonium salt of such polymeric composition. The dissolved polymeric amide/ammonium salt is represented by the formula:

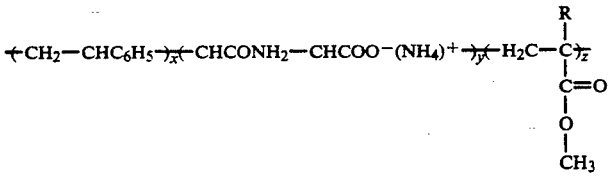

In the above formula, x, y and z are weight fractions (i.e. weight of constituent in the polymer per 100 parts of polymer) of the noted polymerized constituents of the dissolved polymer salt with x being from 0.45 to 0.83 (preferably 0.50 to 0.78), y being from 0.15 to 0.35 (preferably 0.20 to 0.30) and z being from 0.02 to 0.20 (preferably 0.02 to 0.10). R in the above formula is preferably methyl. Preferably no other monomer is present in the polymer.

The polymeric amide/ammonium salt is formed by mixing the polymer in ammonium hydroxide, preferably without the presence of additional components. In doing so, the polymerized maleic anhydride component reacts with the ammonium hydroxide resulting in an amide group becoming attached to one C atom and an ammonium cation associated with a carboxylic anion group. The concentration of polymer salt in solution is 5 to 20 weight %. The weight average molecular weight of the polymer in solution is between 100,000 to 300,000, preferably 100,000 to 200,000 Daltons. This is measured by size exclusion chromatography using three detectors—i.e. low angle laser light scattering, a Water Model 401 Differential Refractive Index Detector and a multi wavelength UV instrument. Water is the solvent and polysaccharide the standard.

The terpolymer of styrene/maleic anhydride/$C_1-C_3$ alkyl methacrylate is known (see U.S. No. 4,305,869) and may be prepared in several ways. One method is mass polymerization which involves heating the monomers at temperatures between 80° C. and 149° C. for several hours or more, such as in a water both. Another method is solvent polymerization which involves reacting the monomers at elevated temperature in the presence of a solvent such as acetone which is capable of dissolving the unpolymerized monomers and the finished terpolymer. If desired, polymerization can be carried out in the presence of a catalyst.

Exemplary of the invention is the following specific example.

EXAMPLE 1

Preparation of Terpolymer of Styrene, Maleic Anhydride and Methyl Methacrylate Maleic anhydride (45.1 gm, 0.46 mole), styrene (145.6 gm, 1.4 mole) and methyl methacrylate (14 gm, 0.14 mole) are charged to a kettle. The kettle is agitated at 60° C. to ensure all maleic anhydride is melted. Tert-butyl peroctoate (2 gm) and methyl ethyl ketone (500 ml) are added and the mixture is heated to 105° C. under a nitrogen atmosphere. Polymerization is evident by an increase in viscosity of the reaction mixture. After 5 hrs the batch is cooled to room temperature. The viscous syrupy solution is coagulated in a large quantity of hexane. The polymer is precipitated and dried in a vacuum oven overnight. Analysis showed styrene/maleic anhydride/methyl methacrylate weight ratios of 0.71/0.22/0.07 by integrating peaks of the NMR spectrum.

Preparation of the Amide/Ammonium Salt Solution of the Styrene Maleic Anhydride Methyl Methacrylate Terpolymer.

The above-prepared styrene-maleic anhydride-methyl methacrylate terpolymer (120 gm) and water (1044 gm) are charged to a kettle. The water is stirred to wet the terpolymer at 95° C. Thirty percent aqueous ammonium hydroxide (36 gm) solution is added through an addition funnel over 2 hours. The reaction mixture becomes a homogeneous translucent solution. Once the temperature of the solution reaches room temperature the pH is adjusted to 9.5. The infrared spectrum of the isolated solid shows an ester carbonyl stretching band at 1735 $cm^{-1}$ and carboxylic salt carbonyl stretching band at 1450 $cm^{-1}$.

Evaluation of Amide/Ammonium Polymeric Salt Solution As Paper Surface Sizing Agent Ten gm of corn starch in 100 gm of water are heated at 90° C for 30 minutes. To aid miscibility the starch solution is diluted with an additional 100 gm of water. Then the pH of the solution is adjusted with caustic soda to 8. 10 gms of the amide/ammonium salt of the styrene/maleic anhydride/methyl methacrylate terpolymer as a 10% solids concentration in water are mixed with the starch solution to prepare the surface sizing formulation. The surface sizing solution is held in a 55° C. water bath until used in the size press. The press used is a horizontal size press which is a two roll metering device which applies the surface sizing solution to paper sheet as the latter passes downwardly through a nip defined between a sheet contact surface of a first roll and a sheet contact surface of a second roll. The rolls turn in opposite direction in the horizontal plane. The above-prepared surface sizing solution is applied to the paper stock (alkaline paper containing 12% precipitated calcium carbonate, 0.5 % ammonium and 0.03% alkyl ketene dimer) through the horizontal size press at 90° C. The amount of sizing solution taken up by the paper was 0.097 gm per square meter. The paper is redried after application of the alkaline sizing solution.

The sized paper is tested for ink penetration using a Hercules® sizing test apparatus. In this test (conducted at 23° C.), the change is noted in light reflection from the surface of one side of the sized paper sample as ink or a colored solution of naphthol green dye (to simulate ink) is allowed to penetrate from the other side. The naphthol green dye is confined within a ring on the top side of a section of sized paper and the change in light reflectance from the bottom side is measured photoelectrically. An end point of 80% reduction in reflected light is chosen. The reflectance measuring system includes a timer measuring seconds which stops automatically when the reflected light falls below 80%. The time in seconds which has passed from the start of the test until the point at which reduction in reflected light is 80% is recorded. The higher the number of recorded seconds, the better is the performance of the sizing agent in the test. Six samples are tested and the result is the average thereof. In the present Example such elapsed time was 113 seconds.

EXAMPLE C1

This control example is not according to the invention (A) The above paper sizing evaluation procedure was repeated except that the amide/ammonium salt is prepared from a copolymer of styrene and maleic anhydride (0.52/0.48 styrene/maleic anhydride weight ratio) without the presence of methyl methacrylate. The result of the Hercules Sizing Test is 58 seconds.

(B) The paper sizing evaluation procedure was repeated except that the amide/ammonium salt is prepared from a copolymer of styrene(s) and monoisobutyl maleate (MIBM) at a 0.45/0.55 weight ratio of S/MIBM. Molecular weight was 120,000 Daltons. This copolymer is prepared by first reacting maleic anhydride with isobutanol to form mono-isobutyl maleate and then subsequently polymerizing the latter with styrene. The result of the Hercules Sizing Test is 47 seconds.

From the above sizing test results, the alkaline sizing formulation according to the invention was in one case 94% and in the second case 240% greater than obtained with prior art ammonium/amide salts in the paper sizing formulation.

The preceding description is for illustration only and is not to be taken in a limited sense. Various modifications and alterations will be readily suggested to persons skilled in the art. It is intended, therefore, that the foregoing be considered as exemplary only and that the scope of the invention be ascertained from the following claims.

I claim:

1. An aqueous solution of polymer for sizing paper wherein the polymer consists essentially of copolymerized units represented by the formula:

$$CH_2—CHC_6H_5CHCONH_2—CHCOO^-(NH_4)$$

and such polymer includes copolymerized monomer of the formula:

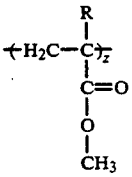

wherein x, y and z are weight fractions within the following ranges: x from 0.45 to 0.83; y from 0.15 to 0.35: z from 0.02 to 0.20 R and is $C_1$–$C_3$ alkyl.

2. The aqeuous solution of claim 1 wherein R is methyl.

3. The aqeuous solution of claim 1 wherein x is 0.50 to 0.78, y is 0.20 to 0.30 and z is 0.02 to 0.10.

4. The aqeuous solution of any of claims 1, 2 or 3 wherein the concentration of polymer in solution is 5 to 20 weight %.

5. The aqeuous solution of claim 4 wherein the weight average molecular weight of the polymer in solution is between 100,000 to 300,000 Daltons.

* * * * *